US009954311B2

(12) United States Patent
Kato et al.

(10) Patent No.: US 9,954,311 B2
(45) Date of Patent: Apr. 24, 2018

(54) ELECTRIC CONNECTOR

(71) Applicant: ACES ELECTRONICS CO., LTD., Zhongli, Taoyuan County (TW)

(72) Inventors: Nobukazu Kato, Fussa (JP); Norio Yoshida, Atsugi (JP)

(73) Assignee: ACES ELECTRONICS CO., LTD., Zhongli, Taoyuan County (TW)

( * ) Notice: Subject to any disclaimer, the term of this patent is extended or adjusted under 35 U.S.C. 154(b) by 0 days.

(21) Appl. No.: 15/401,725

(22) Filed: Jan. 9, 2017

(65) Prior Publication Data

US 2017/0117663 A1 Apr. 27, 2017

Related U.S. Application Data

(63) Continuation of application No. 14/636,742, filed on Mar. 3, 2015, now Pat. No. 9,577,373.

(30) Foreign Application Priority Data

Mar. 7, 2014 (JP) ..... 2014-044651

(51) Int. Cl.
*H01R 13/405* (2006.01)
*H01R 13/52* (2006.01)
(Continued)

(52) U.S. Cl.
CPC ..... *H01R 13/6275* (2013.01); *H01R 13/405* (2013.01); *H01R 13/5202* (2013.01);
(Continued)

(58) Field of Classification Search
CPC ..... H01R 13/52; H01R 13/5202; H01R 13/5216; H01R 13/6471; H01R 13/6272;
(Continued)

(56) References Cited

U.S. PATENT DOCUMENTS 6,799,986 B2 10/2004 Igarashi et al.
7,165,995 B2 1/2007 Fukushima et al.
(Continued)

FOREIGN PATENT DOCUMENTS

JP H8-321358 A 3/1996
JP 2011-86473 A 4/2011
JP 5197742 B2 5/2013

OTHER PUBLICATIONS

Japanese Notification of Reasons for Refusal dated Dec. 19, 2017, for corresponding Japanese Application No. 2014-044651; pp. 1-9.

*Primary Examiner* — James Harvey
*Assistant Examiner* — Oscar Jimenez
(74) *Attorney, Agent, or Firm* — Chiesa Shahinian & Giantomasi PC

(57) ABSTRACT

An electric connector includes a first connector 2 and a second connector 22. The first connector includes a first contact 4, a second contact 6, a plate like ground plate 8 arranged between the first and second contacts, and a first housing that holds the first contact, the second contact, and the ground plate. The second connector includes a third contact 30 connected to the first contact, a fourth contact 32 connected to the second contact, and a ground metal part arranged at both ends of the third and fourth contacts in a contact array direction and configured to be in contact with the ground plate, and a second housing that holds the third and fourth contacts and the ground metal part. The ground plate includes a projecting portion formed on both side surfaces in the contact array direction and come in contact with the ground metal part.

18 Claims, 23 Drawing Sheets

(51) Int. Cl.
*H01R 13/627* (2006.01)
*H01R 24/60* (2011.01)
*H01R 107/00* (2006.01)

(52) U.S. Cl.
CPC ..... *H01R 13/5216* (2013.01); *H01R 24/60* (2013.01); *H01R 2107/00* (2013.01)

(58) Field of Classification Search
CPC H01R 13/6583; H01R 13/6585; H01R 31/06; H01R 4/64
See application file for complete search history.

(56) References Cited

U.S. PATENT DOCUMENTS 8,262,411 B2 9/2012 Kondo
9,214,766 B1 12/2015 Yu et al.
9,231,356 B1 1/2016 Ju et al.
2012/0315779 A1* 12/2012 Yudate ..... H01R 12/724 439/271
2013/0019471 A1 1/2013 Omae et al.
2014/0024257 A1* 1/2014 Castillo ..... H01R 13/6585 439/607.05
2014/0308833 A1 10/2014 Fukami et al.
2015/0024612 A1 1/2015 Little et al.
2015/0044886 A1 2/2015 Little et al.
2015/0072562 A1 3/2015 Little et al.
2015/0093936 A1 4/2015 Little et al.
2015/0126069 A1 5/2015 Little et al.
2015/0171573 A1 6/2015 Little et al.
2015/0244111 A1 8/2015 Ju et al.
2015/0244118 A1 8/2015 Lin et al.
2015/0255925 A1 9/2015 Katayanagi
2015/0270661 A1 9/2015 Kao et al.
2015/0364888 A1 12/2015 Yu et al.
2016/0020572 A1 1/2016 Ju et al.
2016/0043511 A1 2/2016 Hsu
2016/0056586 A1 2/2016 Guo et al.
2016/0064868 A1 3/2016 Little et al.
2016/0064870 A1 3/2016 Yu et al.

* cited by examiner

ELECTRIC CONNECTOR

CROSS-REFERENCE TO RELATED APPLICATIONS

This application is a continuation of U.S. patent application Ser. No. 14/636,742, filed on Mar. 3, 2015, which claims priority to Japanese Patent Application No. 2014-044651, filed on Mar. 7, 2014, the disclosures of which are herein incorporated by reference in their entirety.

TECHNICAL FIELD

The present invention relates to an electric connector.

BACKGROUND ART

A connector with reduced crosstalk between contacts in which a conductor is arranged between first contacts and second contacts (for example, see Patent Literature 1) has been provided.

CITATION LIST

Patent Literature

Patent Literature 1: Japanese Patent No. 5197742

SUMMARY OF INVENTION

Technical Problems

To fit such a connector into an opponent connector and lock this state, a locking hole may be formed in a shell portion of the electric connector mentioned above. When the locking hole is formed in the shell portion, however, it would be difficult to seal the shell portion with resin or the like and the problem of decreasing waterproof property may occur.

A purpose of the present invention is to provide an electric connector having a high waterproof property to ensure proper fitting, while reducing crosstalk between contacts.

Solution to Problem

An electric connector according to an embodiment of the present invention includes a first connector and a second connector. The first connector includes a first contact, a second contact, and a planar ground plate arranged between the first contact and the second contact, and a first housing that configured to hold the first contact, the second contact, and the ground plate. The second connector includes a third contact connected to the first contact, a fourth contact connected to the second contact, a ground metal part arranged on both ends of the third contact and the fourth contact in a contact array direction and configured to be in contact with the ground plate, and a second housing configured to hold the third contact, the fourth contact, and the ground metal part. The ground plate includes a projecting portion formed on both side surfaces of the ground plate. The ground plate includes a projecting portion formed in the contact array direction and configured to be in contact with the ground metal part.

An electric connector according to an embodiment of the present invention is formed as a second connector to which a first connector is connected. The first connector includes a first contact, a second contact, a planar ground plate arranged between the first contact and the second contact, and a first housing configured to hold the first contact, the second contact, and the ground plate. The second connector includes a third contact connected to the first contact, a fourth contact connected to the second contact, and a ground metal part arranged on both ends of the third contact and the fourth contact in a contact array direction and configured to be in contact with the ground plate, and a second housing configured to hold the third contact, the fourth contact, and the ground metal part. The ground plate includes a projecting portion formed on both side surfaces of the ground plate in the contact array direction and configured to be in contact with the ground metal part.

An electric connector according to an embodiment of the present invention is formed as a first connector to which a second connector is connected. The first connector includes a first contact, a second contact, a planar ground plate arranged between the first contact and the second contact, and a first housing configured to hold the first contact, the second contact, and the ground plate. The second connector includes a third contact connected to the first contact, a fourth contact connected to the second contact, and a ground metal part arranged on both ends of the third contact and the fourth contact in a contact array direction and configured to be in contact with the ground plate, and a second housing configured to hold the third contact, the fourth contact, and the ground metal part. The ground plate includes a projecting portion formed on both side surfaces of the ground plate in the contact array direction and configured to be in contact with the ground metal part.

According to embodiments of the present invention, an electric connector having a high waterproof property to ensure proper fitting, while reducing crosstalk between contacts is provided.

DESCRIPTION OF EMBODIMENTS

Figure 1:
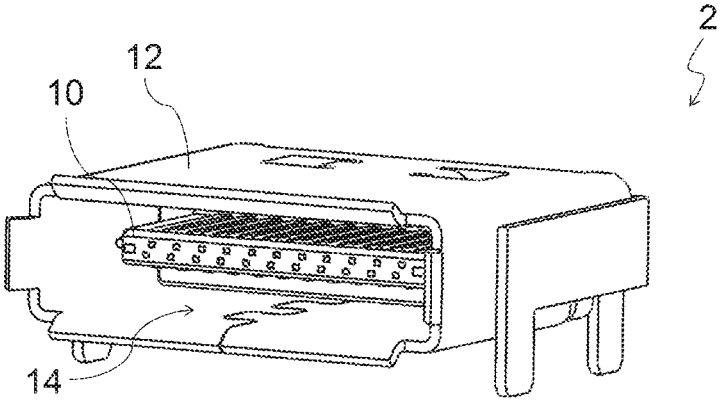
FIG. 1 is a perspective view of a receptacle connector according to an embodiment.

An electric connector according to embodiments of the present invention will be described below by referring to the accompanying drawings. FIG. 1 is a perspective view of a receptacle connector according to an embodiment and FIG. 2 is a cross-sectional view thereof.

Figure 2:
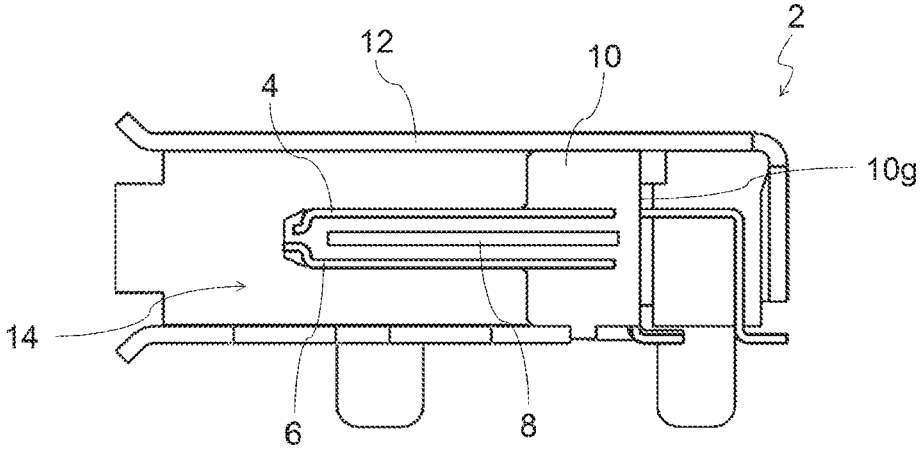
FIG. 2 is a cross-sectional view of the receptacle connector according to the embodiment.

As illustrated in FIGS. 1 and 2, a receptacle connector 2 includes first contacts 4, second contacts 6, a ground plate 8, and a first housing 10 that holds these constituent elements, and a first shell portion 12 that covers the circumference of the first housing 10. An insertion hole 14 functioning as a space for inserting a plug connector 22 (see FIG. 8) is formed in the first shell portion 12. The first housing 10 is arranged in the insertion hole 14. The first housing 10 is formed with a resin member having insulating property. The first contacts 4, the second contacts 6, the ground plate 8, and the first shell portion 12 are formed with metal members each having electric conductivity.

Figure 3:
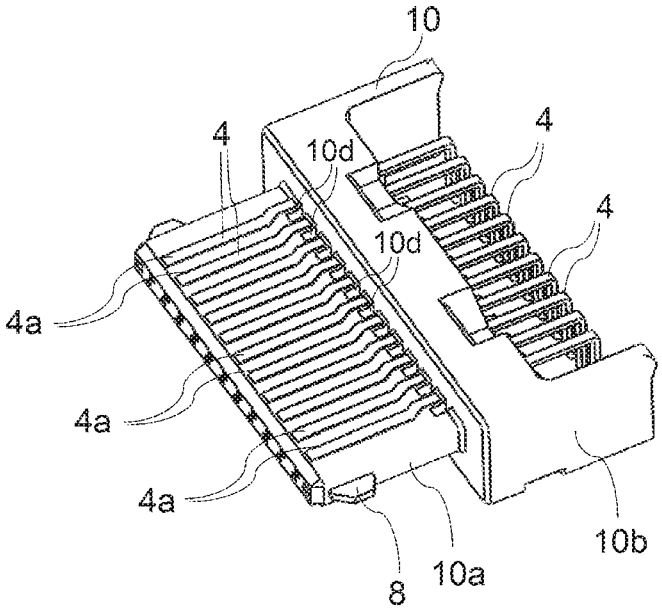
FIG. 3 is a perspective view of a first housing according to the embodiment.
Figure 4:
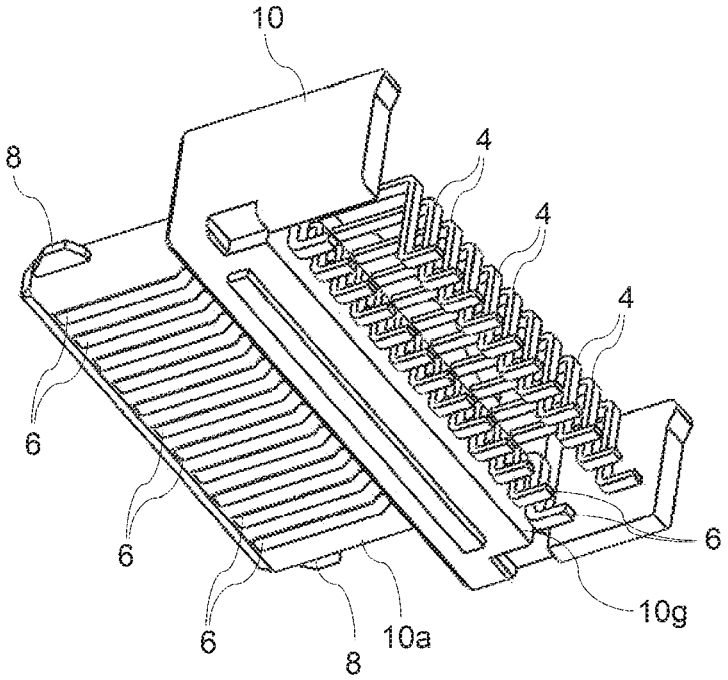
FIG. 4 is a perspective view of the first housing according to the embodiment.
Figure 5:
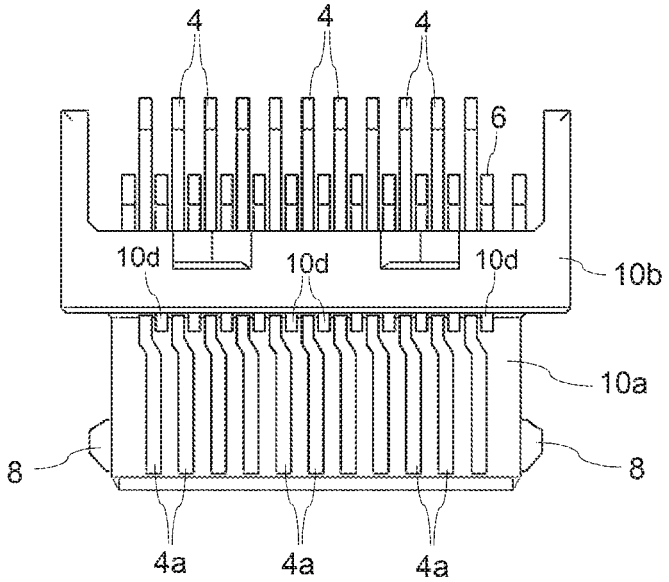
FIG. 5 is a top view illustrating the first housing when seen from above according to the embodiment.

FIGS. 3 and 4 illustrate the first housing according to the embodiment, and FIG. 5 is a top view thereof when seen from above. As illustrated in FIGS. 3 to 5, the first housing 10 includes a plate-like portion 10*a* having a rectangular shape in a planar view, and a body portion 10*b* that holds the plate-like portion 10*a* at a predetermined position in the insertion hole 14.

A plurality of first contacts 4 is formed by insert-molding on the upper surface of the plate-like portion 10*a*. The second contacts 6 having the same number as the first contacts 4 are formed by insert-molding on the lower surface of the plate-like portion 10*a*. The plate like ground plate 8 is formed by insert-molding at a position in the middle of the first and second contacts 4, 6 in the plate-like portion 10*a* (see FIG. 2).

A plurality of openings 10*d* is formed on the body portion 10*b* side on the upper surface of the plate-like portion 10*a* to insert the metal mold part 60 (see FIG. 17) during the insert-molding. Similarly, a plurality of openings (not illustrated) to which the metal mold part 60 is inserted is formed on the body portion 10*b* side on the lower surface of the plate-like portion 10*a*. The openings 10*d* formed on the upper surface of the plate-like portion 10*a* are formed between adjacent first contacts 4. The openings formed on the lower surface of the plate-like portion 10*a* are formed between adjacent second contacts 6.

Figure 6:
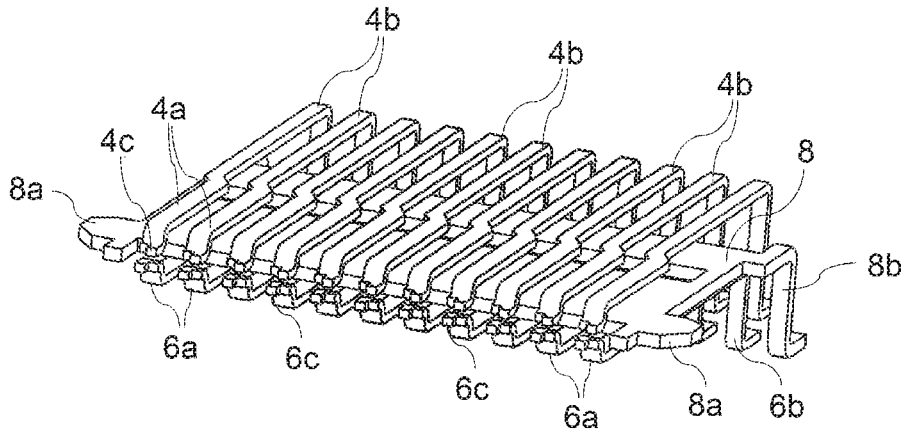
FIG. 6 is a perspective view illustrating first contacts, second contacts, and a ground plate according to the embodiment.
Figure 7:
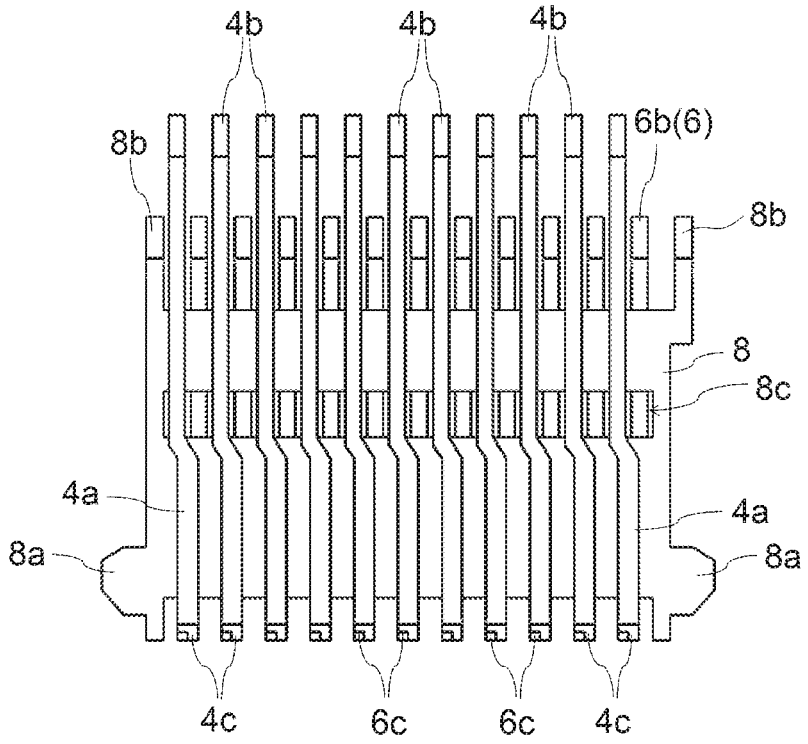
FIG. 7 is a top view illustrating the first contacts, the second contacts, and the ground plate when seen from above according to the embodiment.

FIG. 6 is a perspective view illustrating the first contacts 4, the second contacts 6, and the ground plate 8 according to the embodiment, and FIG. 7 illustrates these constituent elements when seen from above. As illustrated in FIGS. 6 and 7, the first contacts 4 include first contact points 4*a* that come in contact with third contacts 30 (see FIG. 11), and first tail portions 4*b* connected to a circuit board not illustrated and projecting from a rear end 10*g* (see FIG. 2) of the body portion 10*b*. Similarly, the second contacts 6 include second contact points 6*a* that come in contact with fourth contacts 32, and second tail portions 6*b* connected to the circuit board and projecting from the rear end 10*g* of the body portion 10*b*.

The first tail portions 4*b* are shifted toward the left side of FIG. 7 relative to the first contact points 4*a* and coupled. The second tail portions 6*b* are shifted toward the right side of FIG. 7 relative to the second contact points 6*a* and coupled. As illustrated in FIG. 7, therefore, the first tail portions 4*b* and the second tail portions 6*b* are not vertically overlapped one another when the first contact points 4*a* and the second contact points 6*a* are overlapped vertically.

Tip ends 4*c* of the first contact points 4*a* are shaped like notches by cutting the left half of the entire width of each tip end. Tip ends 6*c* of the second contact points 6*a* are shaped like notches by cutting the right half of the entire width of each tip end. Therefore, the tip ends 4*c* and the tip ends 6*c* are not vertically overlapped one another when the first contact points 4*a* and the second contact points 6*a* are overlapped vertically.

Projecting portions 8*a* are formed projecting from both sides of the ground plate 8 on the plate-like portion 10*a* side in a contact array direction. Also, on the side of the body portion 10*b* of the ground plate 8, third tail portions 8*b* are provided projecting from the rear end 10*g* of the body portion 10*b* and connected to the circuit board. Openings 8*c* through which the metal mold part 60 (see FIG. 17) penetrate during insert-molding are formed at positions where the first tail portions 4*b* and the second tail portions 6*b* of the ground plate 8 are not overlapped vertically.

Figure 8:
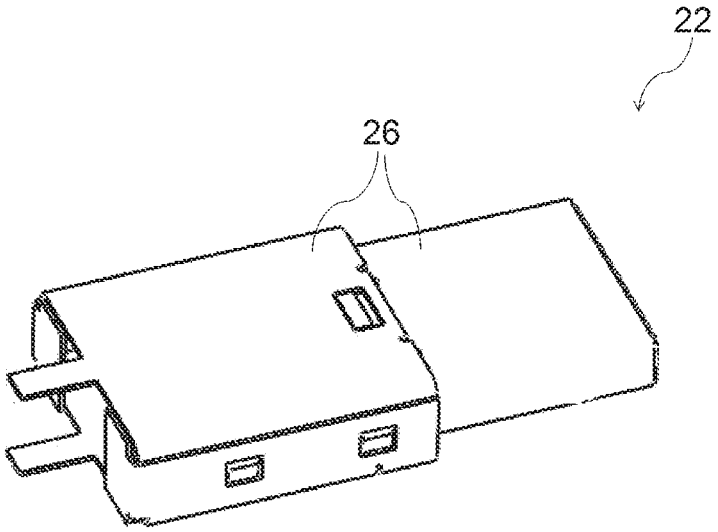
FIG. 8 is a perspective view illustrating a plug connector according to the embodiment.
Figure 9:
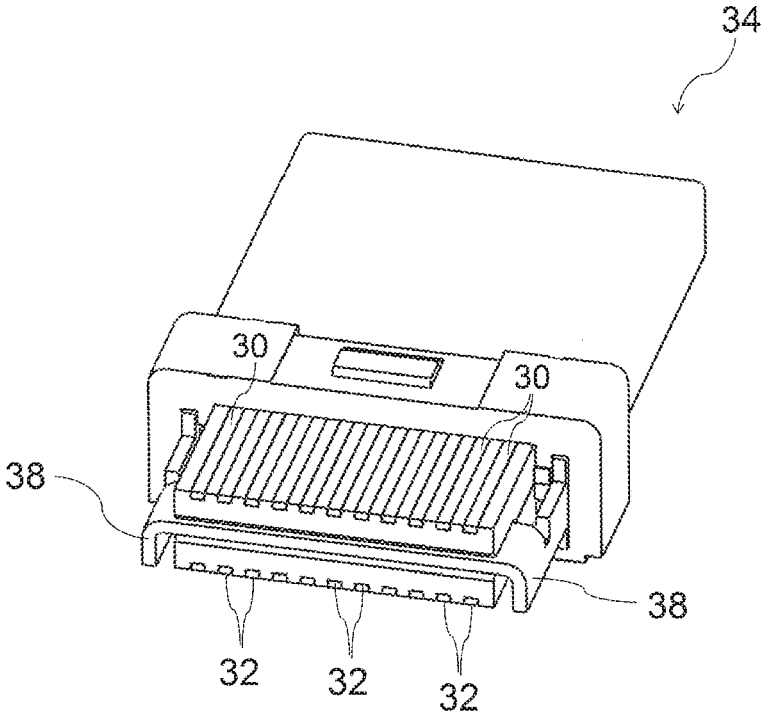
FIG. 9 is a perspective view illustrating a second housing according to the embodiment.
Figure 10:
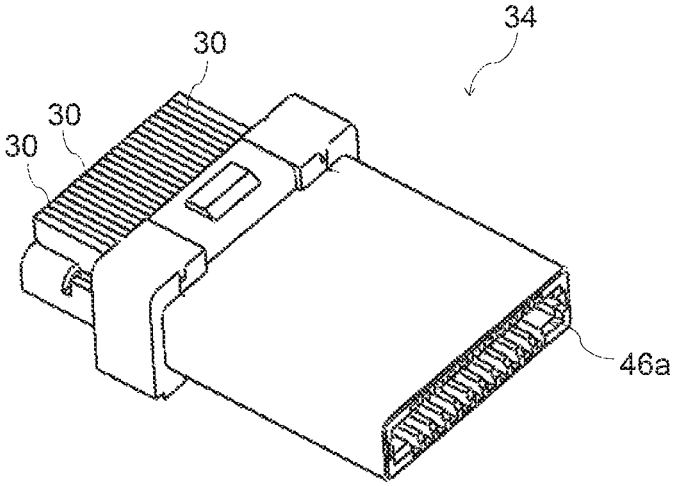
FIG. 10 is a perspective view illustrating the second housing according to the embodiment.

FIG. 8 is a perspective view illustrating a plug connector according to the embodiment, and FIGS. 9 and 10 are perspective views illustrating a second housing according to the embodiment. As illustrated in FIGS. 9 and 10, the plug connector 22 includes a second shell portion 26 in which the third contacts 30, the fourth contacts 32, the ground metal part 38, and a second housing 34 that holds these constituent elements are provided. The second housing 34 is formed with a resin member having insulating property. The third contacts 30, the fourth contacts 32, the ground metal part 38, and the second shell portion 26 are formed with metal members having electric conductivity.

Figure 11:
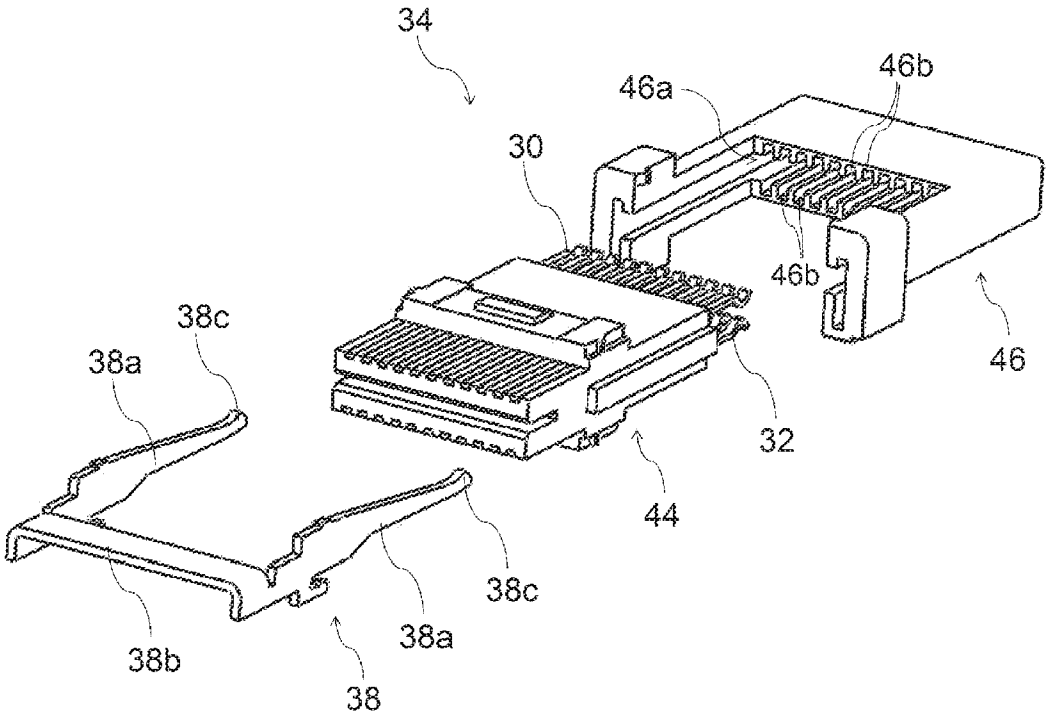
FIG. 11 is a perspective view illustrating a disassembled state of the second housing according to the embodiment.

FIG. 11 is a perspective view illustrating a disassembled state of the second housing 34 according to the embodiment. As illustrated in FIG. 11, the second housing 34 is disassembled into a contact holding unit 44 and a receiving unit 46. The third contacts 30 and the fourth contacts 32 are formed by insert-molding in the second housing 34. The receiving unit 46 receives the contact holding unit 44. The ground metal part 38 is removably assembled on the second housing 34.

Figure 12:
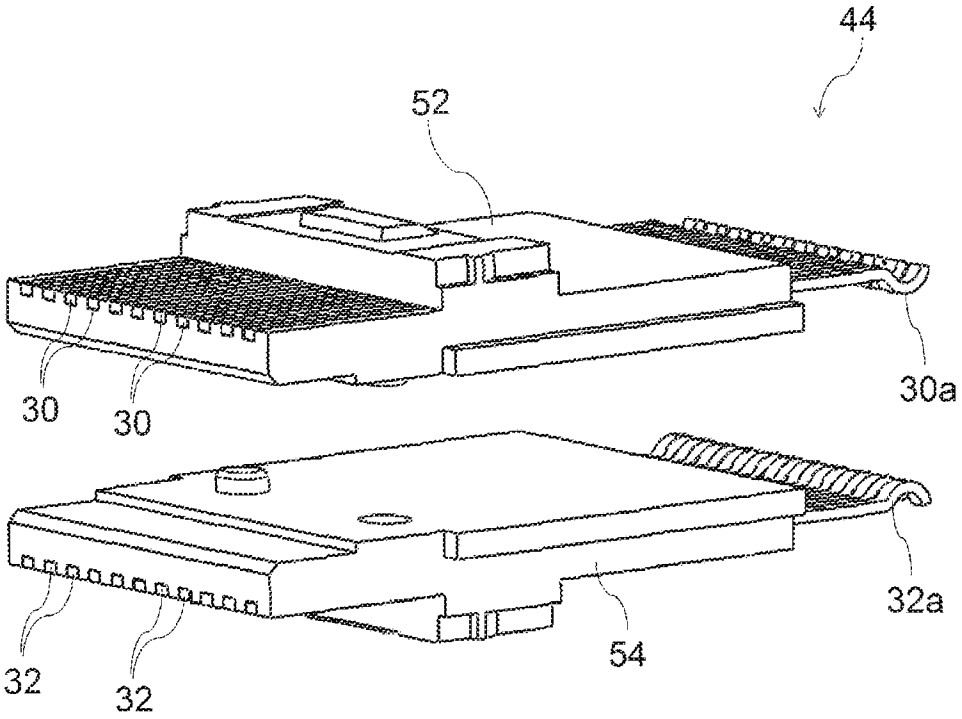
FIG. 12 is a perspective view illustrating a divided state of a contact holding unit divided into upper and lower portions.

As illustrated in FIG. 12, the contact holding unit 44 is further divided vertically into a third contact holding unit 52 that holds the third contacts 30 and a fourth contact holding unit 54 that holds the fourth contacts 32. It is possible therefore to form the third contact holding unit 52 and the fourth contact holding unit 54 separately by insert-molding, such that the plug connector 22 can be manufactured more easily compared to manufacturing the contact holding unit 44 as an integral unit.

Third contact points 30*a* that come into contact with the first contacts 4 are exposed from the end of the third contact holding unit 52 on the receiving unit 46 side. Fourth contact points 32*a* that come into contact with the second contacts 6 are exposed from the end of the fourth contact holding unit 54 on the receiving unit 46 side. The third contact points 30*a* and the fourth contact points 32*a* are arranged at positions where they are overlapped vertically.

A receiving recess 46*a* that receives the plate-like portion 10*a* of the receptacle connector 2 is formed in the receiving unit 46. Grooves 46*b* into which the third contact points 30*a* and the fourth contact points 32*a* are inserted are formed on the inner wall surface of the receiving recess 46*a*.

The ground metal part 38 includes a pair of frames 38*a* that come in contact with the ground plate 8, and a coupling portion 38*b* that couples between the rear ends of the frames 38*a*. As a result of coupling the frames 38*a* by the coupling portion 38*b*, the frames 38*a* can be made not to be swayed when the plug connector 22 is fit into the receptacle connector 2. It is possible therefore to prevent loosening of the press-fit state of the frames 38*a* into the second housing 34. Hook portions 38*c* engaging with each of the projecting portions 8*a* of the ground plate 8 are formed on the tip ends of the frames 38*a*.

Figure 13:
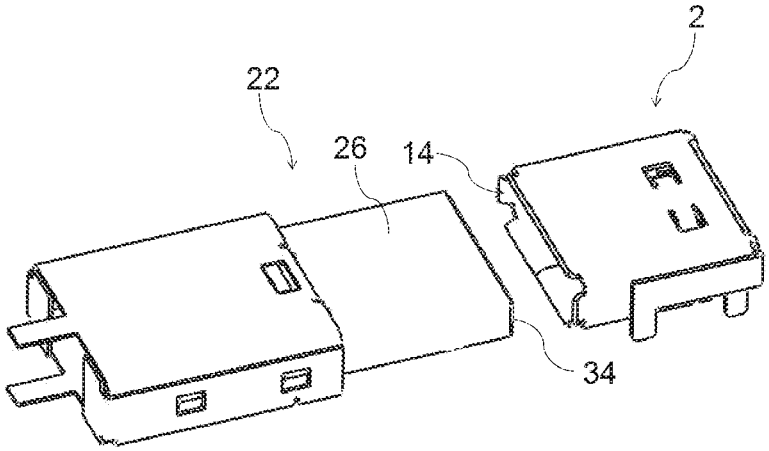
FIG. 13 is a perspective view illustrating a receptacle connector and a plug connector according to the embodiment.
Figure 14:
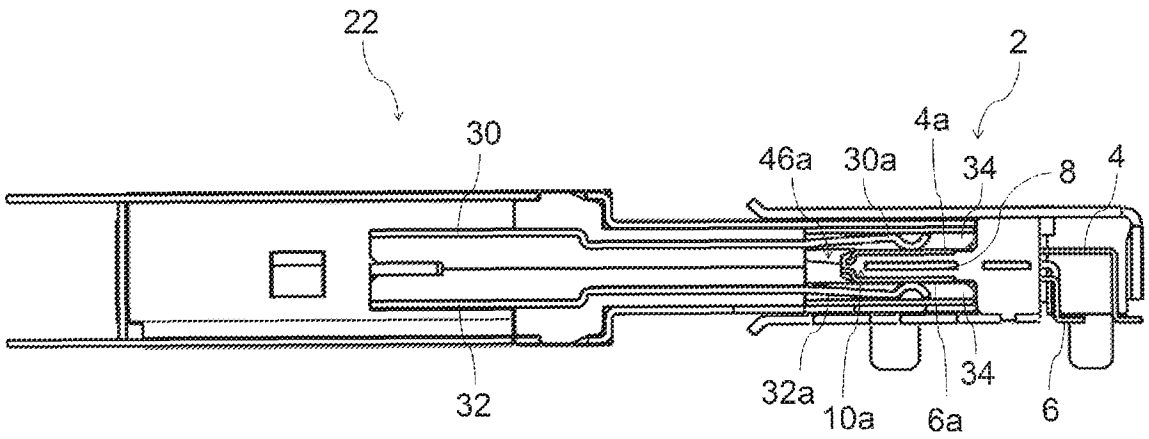
FIG. 14 is a cross-sectional view illustrating the receptacle connector and the plug connector being fitted with each other according to the embodiment.

Next, fitting the plug connector 22 into the receptacle connector 2 will be described by referring to the drawings. First, as illustrated in FIG. 13, the receptacle connector 2 and the plug connector 22 are arranged to face each other. When the second housing 34 of the plug connector 22 is inserted into the insertion hole 14 of the receptacle connector 2, the plate-like portion 10*a* of the receptacle connector 2 is received by the receiving recess 46*a* of the second housing 34, as illustrated in FIG. 14. The first contact points 4*a* come into contact with the third contact points 30*a* to electrically connect the first contacts 4 with the third contacts 30. Similarly, the second contact points 6*a* come into contact with the fourth contact points 32*a* to electrically connect the second contacts 6 with the fourth contacts 32.

Figure 15:
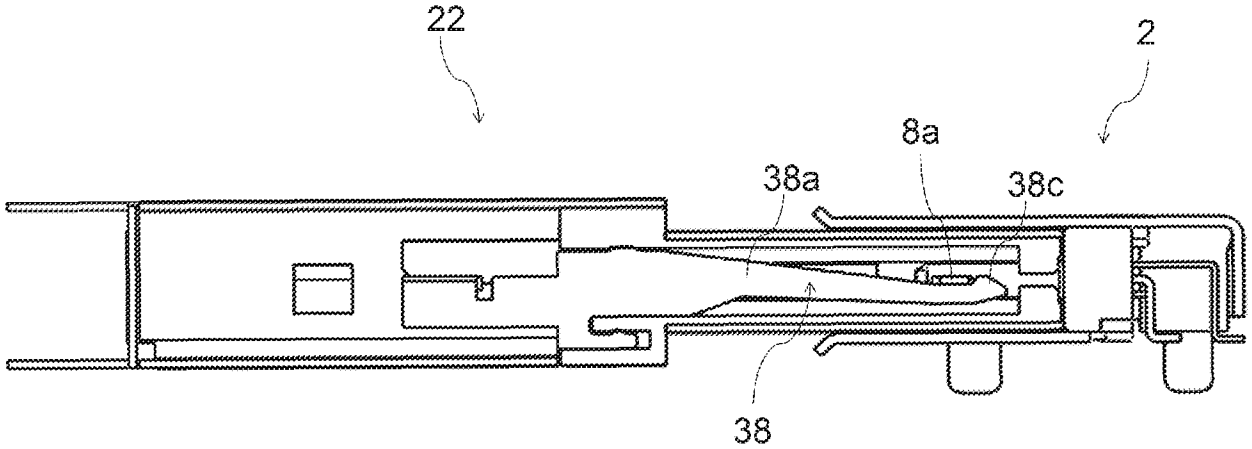
FIG. 15 is a cross-sectional view illustrating the receptacle connector and the plug connector being fitted with each other according to the embodiment.

As illustrated in FIG. 15, the frames 38*a* of the ground metal part 38 come into contact with the lower surfaces of the projecting portions 8*a* of the ground plate 8, and the hook portions 38*c* engage with the projecting portions 8*a*. Accordingly, the ground metal part 38 and the ground plate 8 are electrically connected, while the plug connector 22 is fit into the receptacle connector 2 and locked in this state, such that removing the plug connector 22 from the receptacle connector 2 can be prevented. The ground metal part 38 may be arranged upside down in the plug connector 22. In this case, the frames 38*a* come into contact with the upper surfaces of the projecting portions 8*a* of the ground plate 8.

Figure 16:
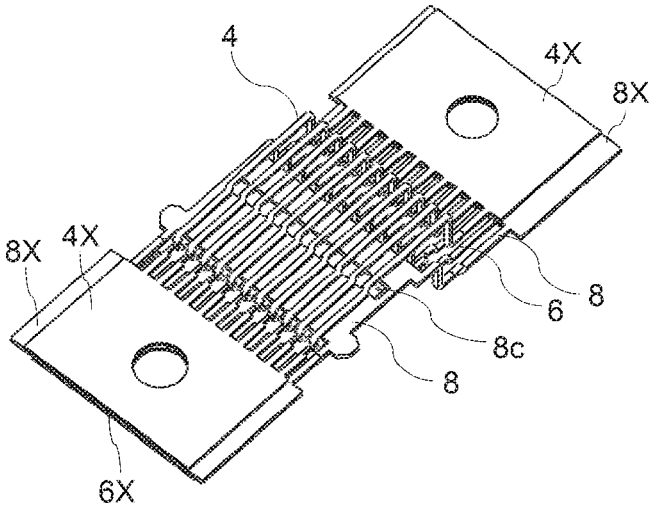
FIG. 16 illustrates the first contacts, the second contacts, and the ground plate arranged for insert-molding according to the embodiment.

Next, insert-molding of the first contacts 4, the second contacts 6, and the ground plate 8 in the receptacle connector 2 according to the embodiment will be described by referring to the drawings. As illustrated in FIG. 16, the first contacts 4 connected with a first carrier 4*x*, the second contacts 6 connected with a second carrier 6*x*, and the ground plate 8 connected with a third carrier 8*x* are arranged. The first carrier 4*x*, the second carrier 6*x*, and the third carrier 8*x* are pressed by a tool not illustrated so as to hold the first contacts 4, the second contacts 6, and the ground plate 8 at predetermined positions.

Figure 17:
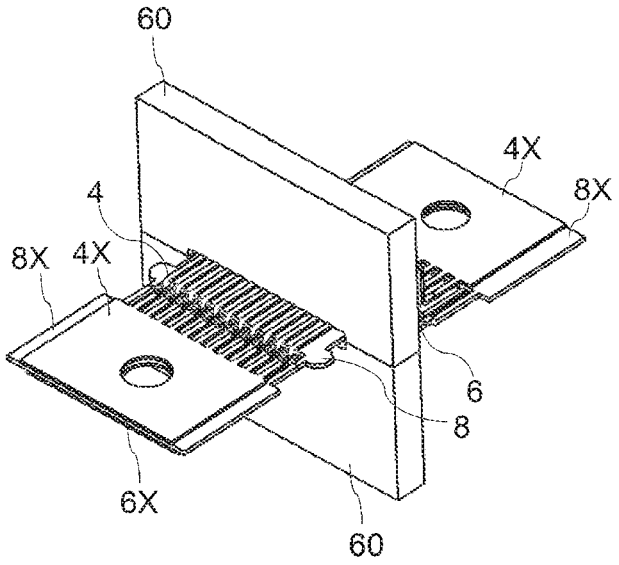
FIG. 17 is a perspective view illustrating the first contacts and the second contacts being fixed by a metal mold part according to the embodiment.
Figure 18:
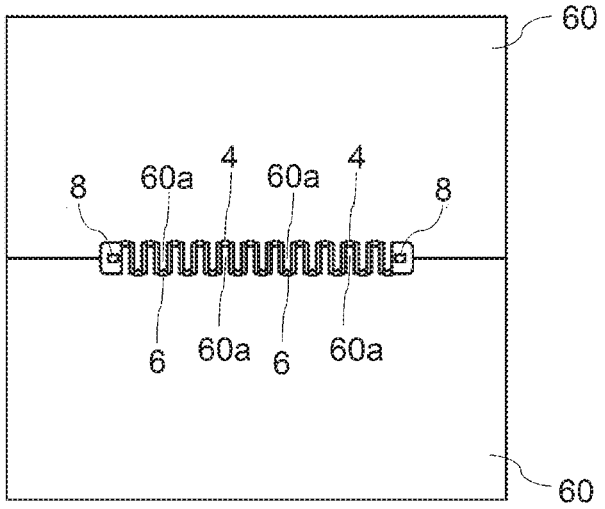
FIG. 18 is a cross-sectional view illustrating the first contacts and the second contacts being fixed by the metal mold part according to the embodiment.

As illustrated in FIGS. 17 and 18, the first contacts 4 and the second contacts 6 are pressed from a vertical direction by the metal mold part 60. In this state, the tip ends 60*a* of upper and lower portions of the metal mold part 60 penetrate through the openings 8*c* (see FIG. 16) of the ground plate 8.

The tip ends 4*c* of the first contact points 4*a* and the tip ends 6*c* of the second contact points 6*a* (see FIGS. 6 and 7) are also pressed vertically, although not illustrated, from a vertical direction by a metal mold member (not illustrated). The first contacts 4 and the second contacts 6 are therefore made not to be swayed during injection molding of a resin member.

Figure 19:
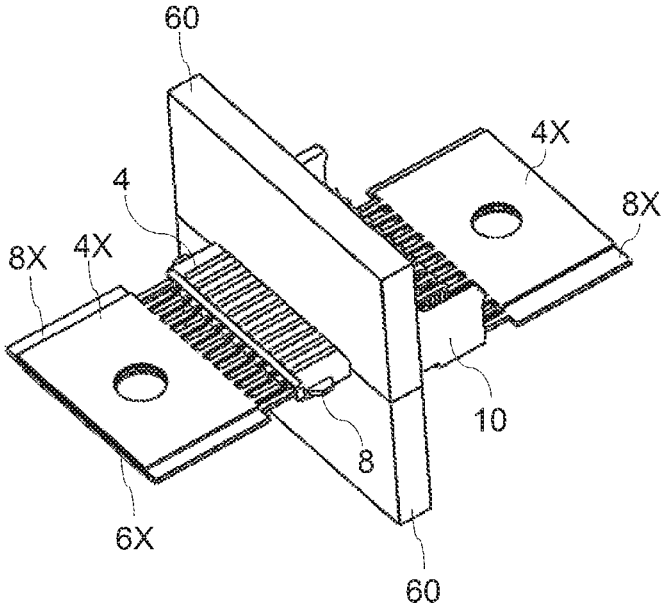
FIG. 19 is a perspective view illustrating first contacts and second contacts being fixed by the metal mold part to form a first housing according to the embodiment.
Figure 20:
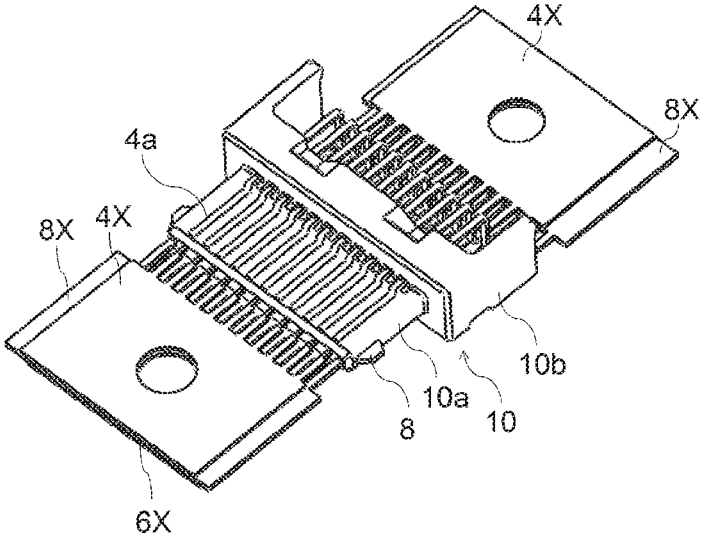
FIG. 20 is a perspective view illustrating the first housing formed according to the embodiment.

Next, as illustrated in FIG. 19, the resin member is formed by injection molding with the first contacts 4 and the second contacts 6 being fixed by the metal mold part 60 and the metal mold member, to thereby form the first housing 10. As illustrated in FIG. 20, after the metal mold part 60 and the metal mold member are removed, the first carrier 4*x*, the second carrier 6*x*, and the third carrier 8*x* are cut off to complete the first housing 10 shaped as illustrated in FIG. 3.

With the electric connector according to the embodiment, the hook portions 38*c* of the ground metal part 38 are made to engage with the projecting portions 8*a* of the ground plate 8, such that the plug connector 22 can be fit into the receptacle connector 2 and locked. It is therefore not necessary to form a lock hole in the outer wall surface of the first shell portion 12 and facilitates waterproof processing of the first shell portion 12. Since there is no need to provide the lock hole in the outer wall surface of the first shell portion 12, there would be no need to provide a spring or the like, for engaging with the lock hole, in the second shell portion 26. Thus, a smaller and thinner electric connector can be achieved.

Since the ground plate 8 is arranged between the first contacts 4 and the second contacts 6, the first contacts 4 and the second contacts 6 can be securely cut off to reduce the crosstalk between the contacts. It is therefore possible to provide an electric connector having a high waterproof property and capable of fitting the contacts securely while reducing the crosstalk between the contacts. By arranging the ground plate 8 between the first contacts 4 and the second contacts 6, strength and high-speed transmission performance of the receptacle connector 2 can be improved.

Since the receptacle connector 2 includes the first contact points 4*a* and the second contact points 6*a* arranged symmetrically in a vertical direction (see FIG. 6), and the plug connector 22 includes the third contact points 30*a* and the fourth contact points 32*a* arranged symmetrically in a vertical direction (see FIG. 12), it is possible to provide a reversible electric connector capable of connecting even when the receptacle connector 2 or the plug connectors 22 is arranged upside down. In this case, the first tail portions 4*b* and the second tail portions 6*b*, and the tip ends 4*c* of the first contact points 4*a* and the tip ends 6*c* of the second contact points 6*a* are not overlapped each other vertically, the first contacts 4 and the second contacts 6 can be securely pressed down by the metal mold part 60 and the metal mold member during press-fitting of the resin member (see FIGS. 17 and 18).

In the above embodiment, it has been illustrated that the receptacle connector 2 and the plug connector 22 include the first shell portion 12 and the second shell portion 26, respectively. Alternatively, however, the receptacle connector 2 and the plug connector 22 may not include the first shell portion 12 and the second shell portion 26, respectively.

In the above embodiment, the first contacts 4, the second contacts 6, and the ground plate 8 are not necessarily formed collectively by insert-molding. Instead, at least one of the first contacts 4, the second contacts 6, and the ground plate 8 may be formed by insert-molding.

Figure 21:
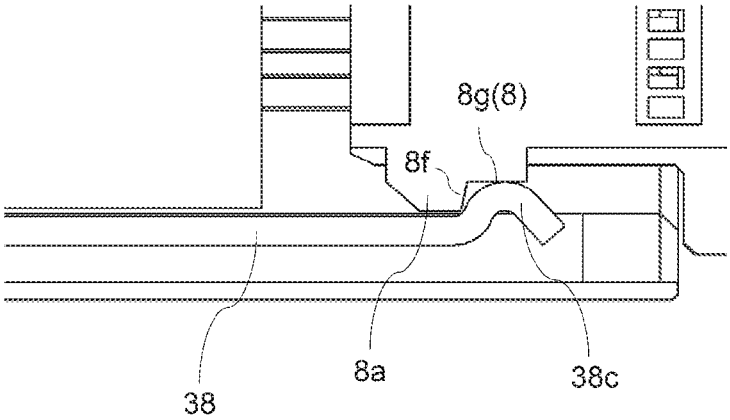
FIG. 21 illustrates a ground metal part and a ground plate according to another embodiment.
Figure 22:
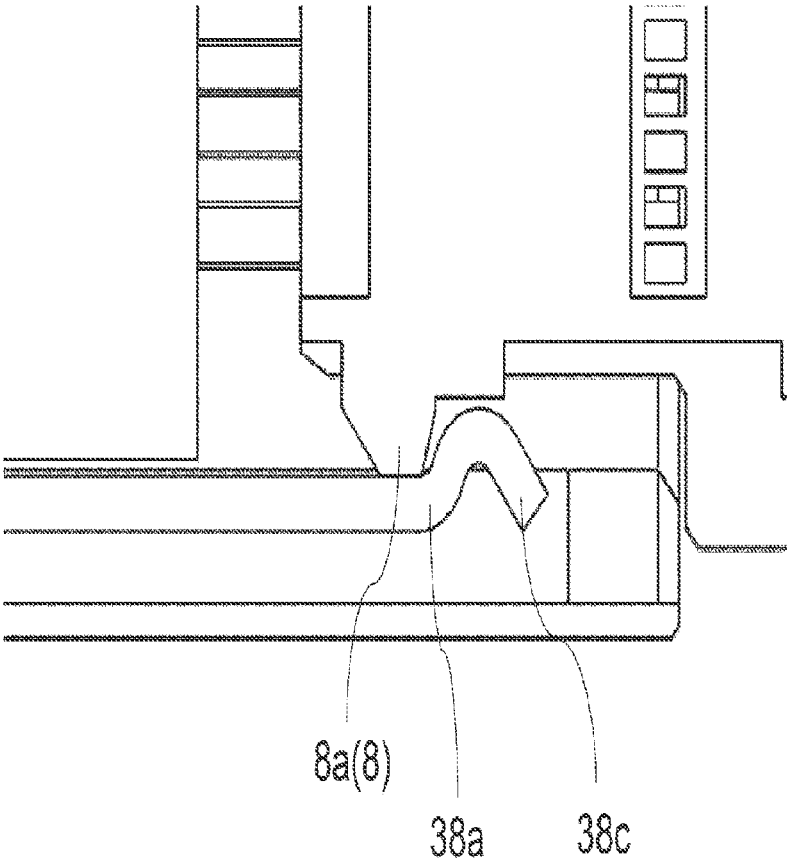
FIG. 22 illustrates the ground metal part and the ground plate according to another embodiment.

In the above embodiment, as illustrated in FIG. 21, the hook portions 38*c* of the ground metal part 38 may be made to project in the contact array direction, and locking portions 8*f* that engage with the hook portions 38*c* and contact portions 8*g* that come into contact with the hook portions 38*c* may be provided on the projecting portions 8*a* of the ground plate 8. As the hook portions 38*c* come into contact with the contact portions 8*g* and engage the locking portions 8*f*, removal of the plug connector 22 from the receptacle connector 2 can be prevented. As illustrated in FIG. 22, the frames 38*a* may be configured to be in contact with the side surface of the projecting portions 8*a*.

Figure 23:
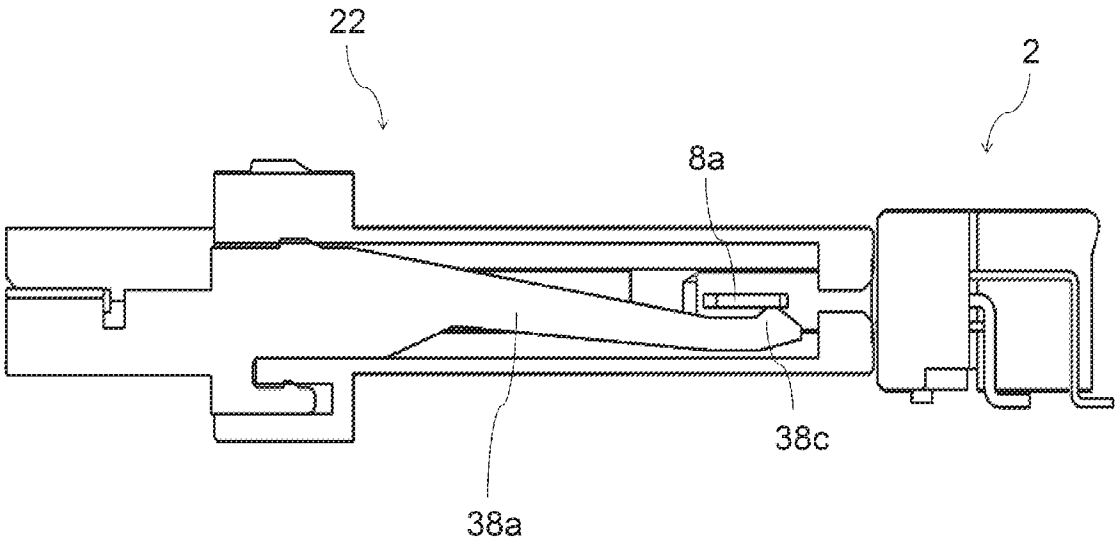
FIG. 23 illustrates the ground metal part and the ground plate according to another embodiment.
Figure 24:
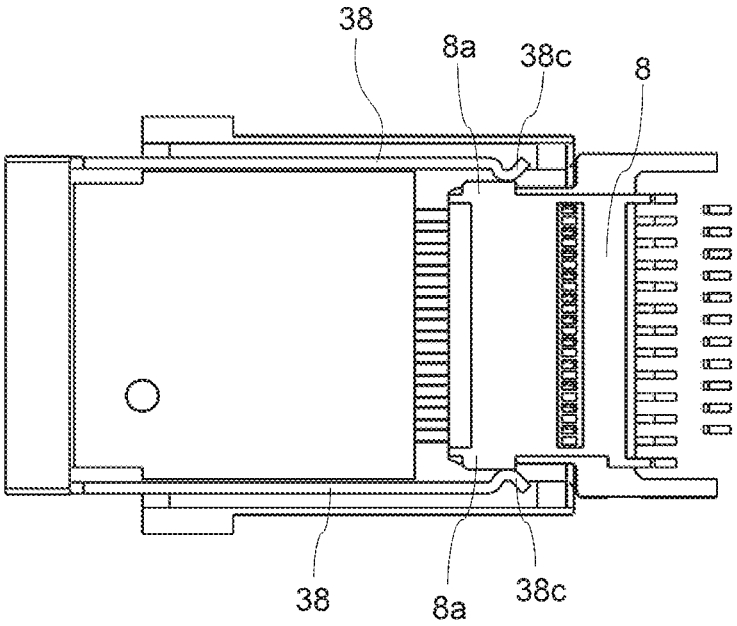
FIG. 24 illustrates the ground metal part and the ground plate according to another embodiment.
Figure 25:
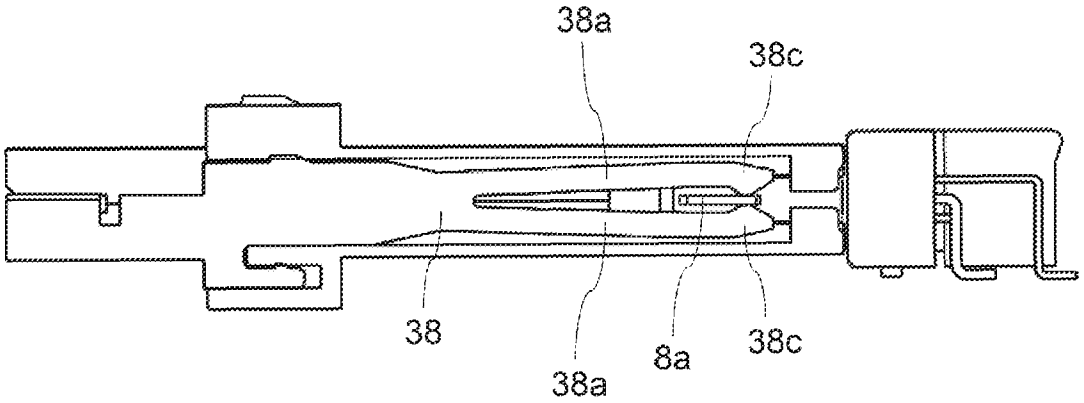
FIG. 25 illustrates the ground metal part and the ground plate according to another embodiment.

In the above embodiment, instead of engaging the hook portions 38*c* with the projecting portions 8*a*, it would also be possible to prevent the removal of the plug connector 22 from the receptacle connector 2 by friction force generated between the hook portions 38*c* and the projecting portions 8*a*. In this case, as illustrated in FIG. 23, the hook portions 38*c* may be made to be in contact with the lower surfaces of the projecting portions 8*a*. Alternatively, as illustrated in FIG. 24, the hook portions 38*c* may be configured to sandwich the ground plate 8 from the side surfaces of the projecting portions 8*a* in the contact array direction. As illustrated in FIG. 25, the ground metal part 38 may include a plurality of frames 38*a* to sandwich the projecting portions 8*a* from upper and lower surfaces thereof. The ground metal part 38 illustrated in FIG. 23 may be arranged upside down in the plug connector 22. In this case, the hook portions 38*c* come in contact with the upper surfaces of the projecting portions 8*a*.

Figure 26:
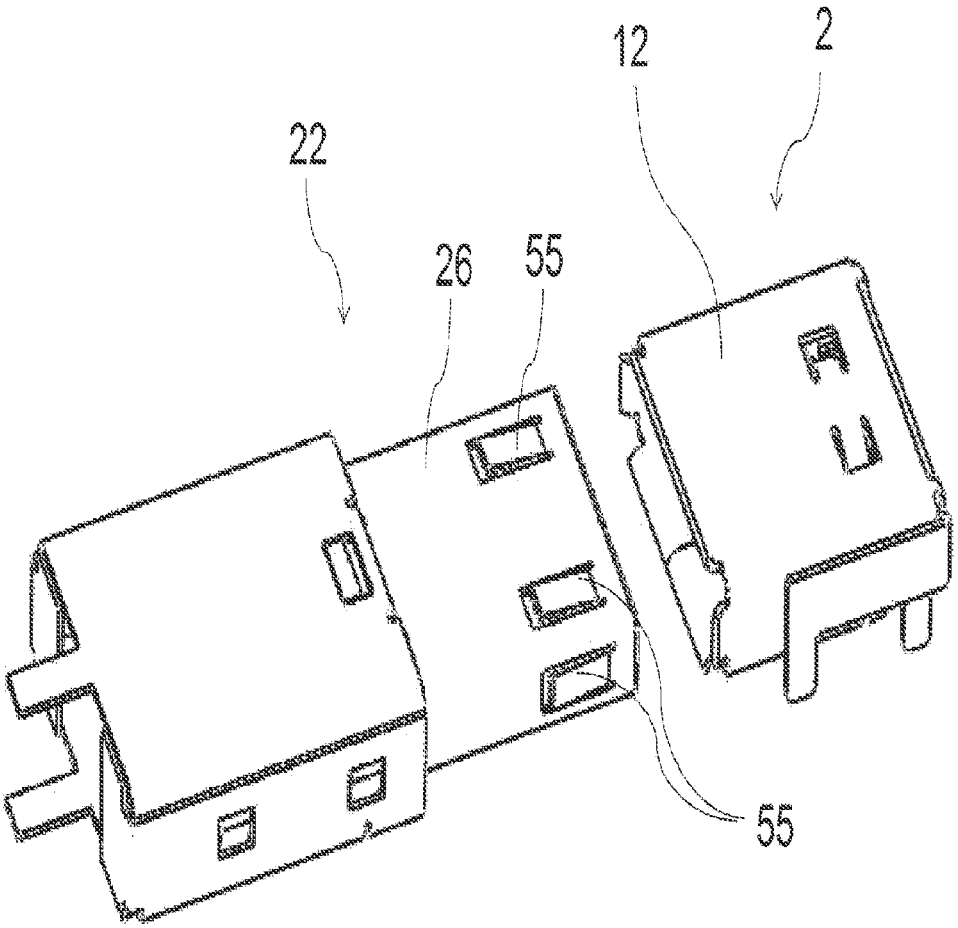
FIG. 26 is a perspective view illustrating a receptacle connector and a plug connector according to another embodiment.

In the above embodiment, as illustrated in FIG. 26, flexible contactors 55 that come into contact with the inner wall surface of the first shell portion 12 may be provided on the outer wall surface of the second shell portion 26. Accordingly, the first shell portion and the second shell portion can be electrically connected with each other accurately when the plug connector 22 is fitted into the receptacle connector 2.

In the above embodiment, the first contacts 4, the second contacts 6, the ground plate 8, and the first shell portion 12 may be formed collectively by insert-molding to improve the waterproof property of the receptacle connector 2.

In the above embodiment, waterproof processing may be performed between the inner wall surface of the first shell portion 12 and the outer wall surface of the first housing 10. For example, a sealing agent may be applied to fill a gap between the inner wall surface of the first shell portion 12 and the outer wall surface of the first housing 10. Alternatively, packing that abuts the inner wall surface of the first shell portion 12 may be provided on the outer wall surface of the first housing 10. At least one of a gap between the first housing 10 and the first contacts 4, a gap between the first housing 10 and the second contacts 6, and a gap between the first housing 10 and the ground plate 8 may be treated by the waterproof processing using a sealing agent or the like.

Figure 27:
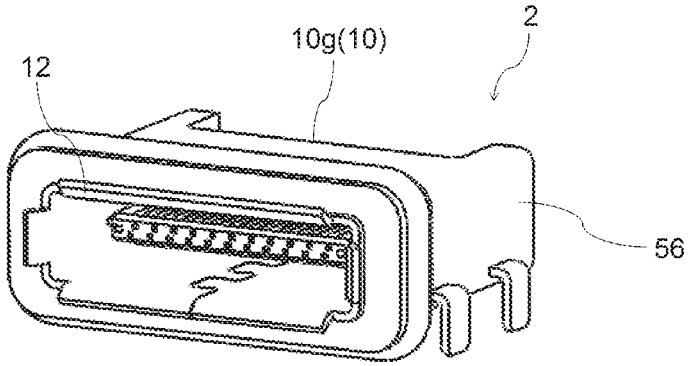
FIG. 27 is a perspective view illustrating a receptacle connector according to another embodiment.
Figure 28:
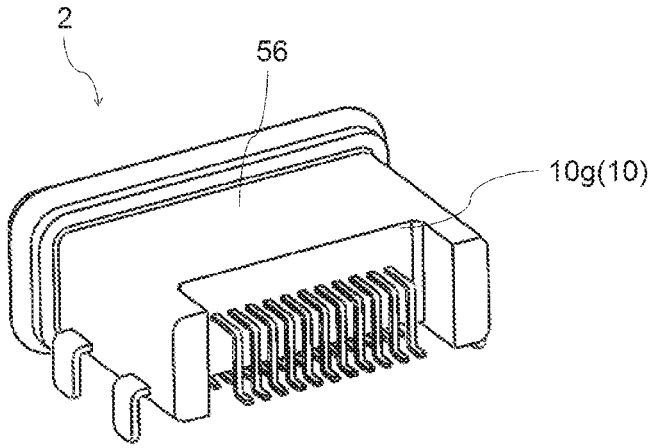
FIG. 28 is a perspective view illustrating the receptacle connector according to another embodiment.

As illustrated in FIGS. 27 and 28, the outer wall surface of the first shell portion 12 and a rear end 10*g* of the first housing 10 may be covered by resin 56 by insert-molding to improve the waterproof property.

In the above embodiment, the receptacle connector 2 may be arranged in a casing of an electronic device, such as a portable phone, and packing that comes into contact with the inner wall surface of the casing of the electronic device may be provided on the outer wall surface of the first shell portion 12. Accordingly, the waterproof processing may be performed in the gap between the casing of the electronic device and the receptacle connector 2. When the receptacle connector 2 does not include the first shell portion 12, packing that comes into contact with the inner wall surface of the casing of the electronic device is provided on the outer wall surface of the first housing 10.

Figure 29:
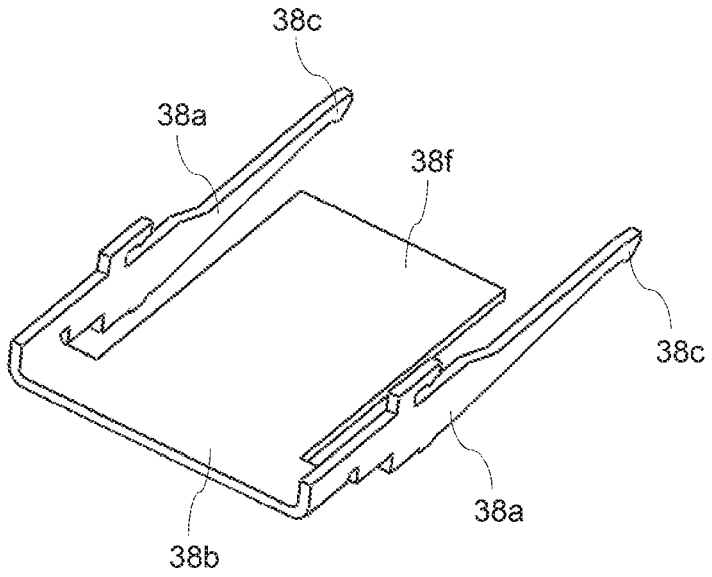
FIG. 29 is a perspective view illustrating a ground metal plate according to another embodiment.

In the above embodiment, as illustrated in FIG. 29, a plate like plate portion 38*f* may be provided at the coupling portion 38*b* of the ground metal part 38. In this case, the plate portion 38*f* comes to a position between the third contacts 30 and the fourth contacts 32 when the plate portion 38*f* is assembled with the contact holding unit 44 (see FIG. 11). It is therefore possible to securely cut off the connection between the third contacts 30 and the fourth contacts 32 to thereby reduce the crosstalk between the contacts even in the plug connector 22.

Figure 30:
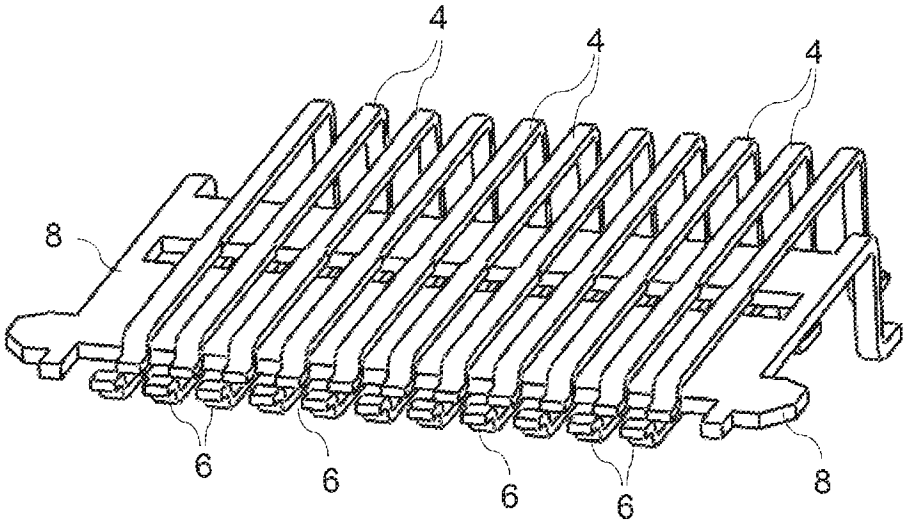
FIG. 30 is a perspective view illustrating first contacts, second contacts, and a ground plate according to another embodiment.
Figure 31:
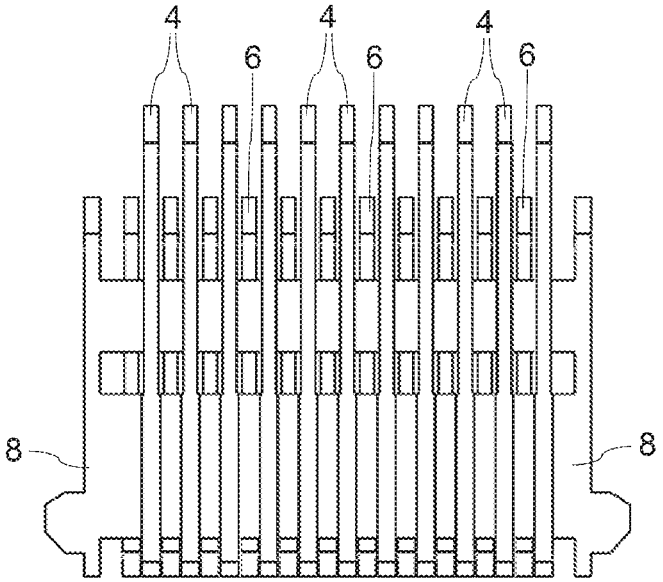
FIG. 31 is a top view illustrating the first contacts, the second contacts, and the ground plate when seen from above according to another embodiment.
Figure 32:
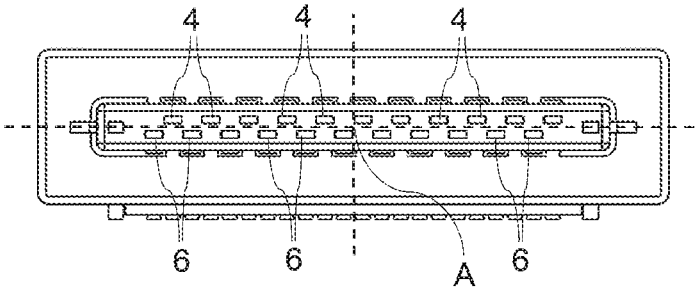
FIG. 32 is a front view of a first housing when seen from front according to another embodiment.

In the above embodiment, the first contacts 4 and the second contacts 6 may not be shifted toward the left or right (see FIG. 7) in order to achieve the arrangement as illustrated in FIGS. 30 and 31 where the first contacts 4 and the second contacts 6 are not vertically overlapped one another. In this case, as illustrated in FIG. 32, the first contacts 4 and the second contacts 6 come to be rotationally symmetrical with each other, with a position of the center part A as a base point in the front view of the first housing 10. With this arrangement, it is also possible to provide a reversible electric connector capable of being connected even when the receptacle connector 2 or the plug connector 22 is arranged upside down.

The above embodiments have been described only for facilitating understanding of the present invention, and not for limiting the scope of the present invention. The constituent elements disclosed in the above embodiments are intended to cover all design modifications and equivalents that belong to the technical scope of the present invention.

The invention claimed is:

1. An electric connector, comprising:

a first connector; and a second connector, wherein the first connector includes a first contact, a second contact, a planar ground plate arranged between the first contact and the second contact, and a first housing configured to hold the first contact, the second contact, and the ground plate, the second connector includes a third contact connected to the first contact, a fourth contact connected to the second contact, a ground metal part arranged on both ends of the third contact and the fourth contact in a contact array direction and configured to be in contact with the ground plate, and a second housing configured to hold the third contact, the fourth contact, and the ground metal part, wherein the ground plate includes a projecting portion formed on both side surfaces of the ground plate in the contact array direction and configured to be in contact with the ground metal part, and the ground metal part is configured to be in contact with at least one of surfaces of an upper surface and a lower surface of the projecting portion in parallel with a surface of the ground plate.

2. The electric connector according to claim 1, wherein the first connector or the second connector is able to be fitted upside down.

3. An electric connector configured to be a second connector to which a first connector is connected, wherein the first connector includes a first contact, a second contact, a planar ground plate arranged between the first contact and the second contact, and a first housing configured to hold the first contact, the second contact, and the ground plate, the second connector includes a third contact connected to the first contact, a fourth contact connected to the second contact, a ground metal part arranged on both ends of the third contact and the fourth contact in a contact array direction and configured to be in contact with the ground plate, and a second housing configured to hold the third contact, the fourth contact, and the ground metal part, wherein the ground plate includes a projecting portion formed on both side surfaces of the ground plate in the contact array direction and configured to be in contact with the ground metal part, and the ground metal part is configured to be in contact with at least one of surfaces of an upper surface and a lower surface of the projecting portion in parallel with a surface of the ground plate.

4. The electric connector according to claim 3, wherein the first connector includes a first shell configured to cover an outer circumference of the first housing, the second connector includes a second shell configured to cover an outer circumference of the second housing, and the second shell includes a flexible contactor configured to be in contact with an inner wall of the first shell.

5. The electric connector according to claim 3, wherein the ground metal part includes a coupling portion at a rear end of the ground metal part to couple a plurality of ground metal parts.

6. The electric connector according to claim 5, wherein the coupling portion includes a planar plate portion arranged between the third contact and the fourth contact and extending toward the first connector side.

7. The electric connector according to claim 3, wherein the second housing is divided into a receiving unit, a third contact holding unit, and a fourth contact holding unit, the receiving unit receiving a tip end of the third contact, a tip end of the fourth contact, and the ground metal part, the third contact holding unit holding the third contact, and the fourth contact holding unit holding the fourth contact.

8. An electric connector configured to be a first connector to which a second connector is connected, wherein the first connector includes a first contact, a second contact different from the first contact, a planar ground plate arranged between the first contact and the second contact, and a first housing configured to hold the first contact, the second contact, and the ground plate, the second connector includes a third contact connected to the first contact, a fourth contact connected to the second contact, a ground metal part arranged on both ends of the third contact and the fourth contact in a contact array direction and configured to be in contact with the ground plate, and a second housing configured to hold the third contact, the fourth contact, and the ground metal part, wherein the ground plate includes a projecting portion formed on both side surfaces of the ground plate in the contact array direction and configured to be in contact with the ground metal part, and the ground metal part is configured to be in contact with at least one of surfaces of an upper surface and a lower surface of the projecting portion in parallel with a surface of the ground plate.

9. The electric connector according to claim 8, wherein the projecting portion includes a locking portion configured to engage with a tip end of the ground metal part and prevent removal of the second connector from the first connector, and the upper surface or the lower surface of the projecting portion is in contact with a portion of the ground metal part located away from the tip end of the ground metal part in a removal direction side of the second connector.

10. The electric connector according to claim 8, wherein at least one of the first contact, the second contact, and the ground plate is formed by insert-molding in the first connector.

11. The electric connector according to claim 8, wherein the first connector includes a plurality of non-overlapping portions where the first contact and the second contact are not overlapped vertically, and the ground plate includes an opening through which a metal mold part protrudes during insert-molding at a position corresponding to at least one of the non-overlapping portions.

12. The electric connector according to claim 8, wherein the first connector includes a first shell configured to cover an outer circumference of the first housing, the second connector includes a second shell configured to cover an outer circumference of the second housing, and the first contact, the second contact, the ground plate, and the first shell are formed by insert-molding in the first connector.

13. The electric connector according to claim 8, wherein the first connector includes a first shell configured to cover an outer circumference of the first housing, the second connector includes a second shell configured to cover an outer circumference of the second housing, and in the first connector, a gap between an inner wall surface of the first shell and an outer wall surface of the first housing is treated by waterproof processing.

14. The electric connector according to claim 13, wherein the waterproof processing is performed by filling a sealing agent in the gap between the first shell and the first housing.

15. The electric connector according to claim 13, wherein the waterproof processing is performed by providing packing that abuts the first shell on the outer wall surface of the first housing.

16. The electric connector according to claim 13, wherein the waterproof processing is performed to at least one of a gap between the first housing and the first contact, a gap between the first housing and the second contact, and a gap between the first housing and the ground plate.

17. The electric connector according to claim 8, wherein the first connector includes a first shell configured to cover an outer circumference of the first housing, the second connector includes a second shell configured to cover an outer circumference of the second housing, and the first connector is treated by waterproof processing of covering an outer wall surface of the first shell and a rear end of the first housing with resin by insert-molding.

18. The electric connector according to claim 8, wherein the first connector includes a first shell configured to cover an outer circumference of the first housing, the second connector includes a second shell configured to cover an outer circumference of the second housing, and the first connector includes packing on an outer wall surface of the first shell or the first housing, the packing abutting an inner wall surface of a casing of an electronic device to which the first connector is attached.

* * * * *